US012534284B2

(12) United States Patent
Presche

(10) Patent No.: US 12,534,284 B2
(45) Date of Patent: Jan. 27, 2026

(54) CLOSURE DEVICE AND METHOD FOR FILLING A CLOSURE DEVICE

(71) Applicant: RPC Bramlage GmbH, Lohne (DE)

(72) Inventor: Martin Presche, Dinklage (DE)

(73) Assignee: RPC Bramlage GmbH, Lohne (DE)

( * ) Notice: Subject to any disclaimer, the term of this patent is extended or adjusted under 35 U.S.C. 154(b) by 69 days.

(21) Appl. No.: 18/687,847

(22) PCT Filed: Sep. 14, 2022

(86) PCT No.: PCT/EP2022/075511
§ 371 (c)(1),
(2) Date: Feb. 29, 2024

(87) PCT Pub. No.: WO2023/041572
PCT Pub. Date: Mar. 23, 2023

(65) Prior Publication Data

US 2024/0351759 A1 Oct. 24, 2024

(30) Foreign Application Priority Data

Sep. 14, 2021 (GB) ..... 2113119

(51) Int. Cl.
*B65D 81/32* (2006.01)
*B65B 3/04* (2006.01)
(Continued)

(52) U.S. Cl.
CPC ..... *B65D 81/3211* (2013.01); *B65B 3/04* (2013.01); *B65D 51/002* (2013.01); *B65D 51/2864* (2013.01)

(58) Field of Classification Search
CPC ..... B65D 47/38; B65D 2217/04; B65D 2217/02; B65D 2217/00; B65D 81/3227;
(Continued)

(56) References Cited

U.S. PATENT DOCUMENTS 8,215,505 B2 * 7/2012 Lee ..... B65D 51/2878 215/DIG. 8
2003/0213709 A1 * 11/2003 Gibler ..... B65D 51/2842 206/219
(Continued)

FOREIGN PATENT DOCUMENTS

KR 10-2010-0082691 A 7/2010
WO 2009/089068 A2 7/2009
(Continued)

OTHER PUBLICATIONS

Notification of Transmittal of the International Search Report and the Written Opinion of the International Searching Authority with attached International Search Report and Written Opinion of the International Searching Authority in PCT/EP2022/075511, mailed Dec. 16, 2022.

*Primary Examiner* — Kareen K Thomas
(74) *Attorney, Agent, or Firm* — Collard & Roe, P.C.

(57) ABSTRACT

A closure device for a container has a lid member for closing the container opening, a chamber associated with the lid member and an inner housing, the chamber and the inner housing having closure means and opening means, which interact with one another in so that a medium contained in the chamber can escape into the container by moving the lid member relative to the inner housing. The chamber is divided by a separating part into a first partial chamber and a second partial chamber, that are arranged one behind the other. A first medium can be received in the first partial chamber and a second medium can be received in the second partial chamber, and by moving the separating part into open position, the first and the second medium can be mixed in the chamber, and the mixed medium can emerge into the container by moving the lid member.

13 Claims, 13 Drawing Sheets

(51) Int. Cl.
*B65D 51/00* (2006.01)
*B65D 51/28* (2006.01)

(58) Field of Classification Search
CPC ..... B65D 81/3211; B65D 51/002; B65D 51/2864; B65D 81/266; B65D 2519/00179; B65B 3/04
See application file for complete search history.

(56) References Cited

U.S. PATENT DOCUMENTS

| | | | | |
|---|---|---|---|---|
| 2011/0259769 | A1* | 10/2011 | Salinas | B65D 51/2864 206/219 |
| 2013/0082022 | A1* | 4/2013 | Cronin | B65D 51/2864 29/428 |
| 2017/0152084 | A1* | 6/2017 | Giovannini | B65D 1/0246 |
| 2018/0186528 | A1* | 7/2018 | Tonn | G01F 11/16 |
| 2018/0305095 | A1* | 10/2018 | Presche | B65D 51/2864 |
| 2020/0122908 | A1* | 4/2020 | Maguire | B65D 51/2892 |
| 2021/0048326 | A1* | 2/2021 | Tonn | G01F 11/32 |
| 2022/0258936 | A1 | 8/2022 | Presche | |

FOREIGN PATENT DOCUMENTS

| | | | |
|---|---|---|---|
| WO | 2018/109446 | A1 | 6/2018 |
| WO | 2020/239834 | A2 | 12/2020 |

* cited by examiner

CLOSURE DEVICE AND METHOD FOR FILLING A CLOSURE DEVICE

CROSS REFERENCE TO RELATED APPLICATIONS

This application is the National Stage of PCT/EP2022/075511 filed on Sep. 14, 2022, which claims priority under 35 U.S.C. § 119 of British Application No. 2113119.8 filed on Sep. 14, 2021, the disclosure of which is incorporated by reference. The international application under PCT article 21(2) was not published in English.

FIELD OF TECHNOLOGY

The invention relates firstly to a closure device for a container having a container opening, the closure device comprising a lid member for closing the container opening, a chamber associated with the lid member and an inner housing, the chamber and the inner housing having mutually corresponding closure means and opening means which interact with one another such that a medium contained in the chamber can escape into the container as a result of movement of the lid member relative to the inner housing.

The invention further relates to a method of filling a closure device for a container, the filled closure device being mountable on a container opening, the closure device comprising a lid member for closing the container opening, a chamber associated with the lid member, and an inner housing, the chamber and the inner housing having mutually corresponding closure means and opening means which interact with one another such that a medium contained in the chamber can escape into the container due to movement of the lid member relative to the inner housing.

STATE OF THE ART

Such closure devices have become known in various aspects. For example, reference should be made to WO 2020/239834 A2 (US 2022/0258936 A1).

In the known closure device, the chamber is closed only by a bottom formed by the inner housing. The uniform chamber space can only be emptied uniformly into the container after rotation of the closure device relative to the container.

SUMMARY OF THE INVENTION

Based on the prior art described above, the disclosed solutions are concerned with the task of favorably designing the chamber with respect to advantageous accommodation of substance.

This task is initially and essentially solved according to a first solution in that the chamber is divided by a separating part into a first partial chamber and a second partial chamber, in that the first partial chamber and the second partial chamber are arranged one behind the other along a central axis of the closure part, in that the separating part can be moved from a closure position into an opening position, that a first medium is receivable in the first partial chamber and a second medium is receivable in the second partial chamber, that a mixing of the first and the second medium in the chamber is achievable by a movement of the separating part into the opening position and that the mixed medium can emerge into the container by moving the lid member.

With regard to the filling method, the task is to specify an advantageous filling method for a closure device with a chamber, also with regard to different media.

This task is solved according to a further solution in that a separating part is provided for dividing the chamber into a first partial chamber and a second partial chamber, according to which the first partial chamber and the second partial chamber are arranged one behind the other along a central axis of the closure part, in that the separating part is moved from a closure position into an opening position, in that the separating part is moved into the open position before being placed on the container and before the inner housing is connected to the lid member, and that the first partial chamber which is opened as a result is filled with a first medium which is or becomes at an overpressure with respect to an ambient pressure, in that the separating part is secured into the closure position by the overpressure, and in that the second partial chamber which is created by the closed position is filled with a second medium.

The division of the chamber into a first and a second partial chamber, by means of a separating part, enables a more favourable use of the chamber, in particular with regard to two and moreover preferably different media. Due to the fact that the separating part can be moved from the closed position into an open position, moreover within the chamber, whereby in this state the division into a first and second partial chamber is suspended, not only a favourable filling is possible, but further also a mixing of the media is achievable, in particular and preferably before a mixed medium enters the container. Nevertheless, the closure device can be used in almost the same way by a user with regard to a release of medium as is the case with the device known for example above from the prior art. The first and the second partial chamber can be filled with different media. By moving the lid member, in particular with respect to a usual removal, in particular unscrewing of the closure device from the container, preferably not only the separation of the first and the second partial chamber can be suspended, but in the course of the further movement also the release of the then mixed medium into the container can be achieved.

The first medium may be a gaseous medium. The gaseous medium may be under overpressure. The gaseous medium under overpressure may at once assist or provide alone securing the closure position of the separating part.

For example, a first partial movement, for example in the course of a user trying to unscrew the closure device from the container, can only cause the separation of the first and second partial chambers to be suspended and the mixing of the first and second media in the chamber to be achieved, and in the course of a further movement, in particular unscrewing of the closure device, then the opening of the chamber thus given again functionally unitary in order to allow the mixed medium to emerge into the container. The first partial movement may be without actual unscrewing, without the movement of the lid member in the direction of the vertical axis, but only by movement of the lid member horizontally. The second partial movement may be with actual unscrewing.

Due to the fact that the separating part, when the inner housing is not yet connected to the chamber, can advantageously be moved into the open position by acting thereon and, correspondingly, when the closure device has not yet been placed on the container, filling of the first partial chamber can be carried out, a favourable handling in the sense of filling can also be carried out at the same time. By filling with a first, preferably gaseous medium having an overpressure, a maintenance of the closure position by the first, preferably gaseous medium itself is then also advantageously achieved upon displacement of the separating part into the closure position. The second partial chamber can then advantageously be filled with the second medium without influencing the first partial chamber.

Preferably, it is further provided that the separating part is movable into the opening position in the direction of the central axis. Accordingly, in the usual state of use, the separating part can be moved by lifting it vertically. This can be conveniently achieved by a derivative from, for example, a unscrewing movement of the closure part from a container.

Further, it is preferably and in detail, where provided, also achievable by the first preferably gaseous medium being under overpressure that the separating part is biased into the closed position. In principle, other possibilities can also be used to bias the separating part into the closed position. For example, a spring acting on the separating part in the first partial chamber created in this way, which spring can be further supported, for example, on an inner surface of the cover element. Such a spring may also be formed integrally with the separating part, or may be inserted separately. The first medium, in such a case, needs not to be under overpressure. It needs also not to be a gaseous medium. It can be a liquid or even (also) a solid medium, such as a powder.

It is further preferred that the separating part comprises a separating wall extending radially and circumferentially to the central axis. In particular, it is preferred that the separating part comprises a separating wall extending substantially perpendicularly to the central axis and being continuously closed.

The separating wall will be in a sealing engagement with the wall of the chamber. Preferably, in the closed position, the separating wall can rest in a sealing manner on an edge of an abutment shoulder of the chamber. The separating wall thus need not necessarily extend over an entire cross-section of the rest of the chamber, which may also be widened outside the abutment shoulder. Advantageously, a sealing contact in the direction of the central axis is thus also achieved. In principle, a sealing arrangement transverse to the central axis or combined in a direction transverse to the central axis and in the direction of the central axis could also be realized.

It is further preferred that the separating part comprises a support extension preferably starting from the separating wall, projecting into the second partial chamber. Hereby, the separating wall can be favourably movable from the closed position into the open position. Further preferably, in this context, it may be provided that the support extension cooperates with a ramp portion formed in the second partial chamber on the bottom side. By this means, in case of an obstructed or different movement about the central axis of the support extension and the separating wall on the one side and the bottom of the second partial chamber on the other side, a run-up onto the ramp part can be achieved and thus a desired movement in the direction of the central axis of the separating wall can be effected.

Further, the separating part may include a spacer extension extending in opposition to the support extension starting preferably also from the separating wall. The separating wall can thereby also be stabilized in further respects. In this context, it is preferred that the support extension abuts a ceiling of the lid member on the inside. Further preferred in this context is that the spacer extension comprises a springable section. When the separating part is moved in the direction of the central axis in order to move the separating wall from the closed position to the open position, a spring deflection can take place at this section. At the same time, at least a support of the closed position may also be achieved hereby. Insofar as the first, in particular gaseous, medium is not under pressure, the closed position can also be secured by this alone, if necessary.

The movement of the separating part into the opening position can be achieved and effected by a movement of the lid member or preferably also of the closure device as a whole, alone. The movement of the separating part into the opening position can be effected, as already noted, in particular by an opening movement, further advantageously by an unscrewing movement of the closure device from the container. In further detail, the ceiling of the lid member may preferably comprise an engagement projection and the spacer extension of the separating part may comprise an engagement part being preferably a part of the spacer extension and further preferably extending in a radial direction with respect to the central axis, for cooperating with the engagement projection. With respect to the unscrewing movement, it is further preferably provided that this corresponds to an unscrewing movement with respect to a sense of rotation, but initially further preferably does not yet cause unscrewing in the sense of a movement—also—in the direction of the central axis via a first movement section. Also, a form fit in the direction of rotation may be provided between the separating part and the lid member in order to achieve, in particular via a rotation of the lid member, at the same time also a rotation of the separating part, for example for cooperation with a ramp formation. It can also be achieved that in the course of a movement of the separating wall from the closed position into the open position, a rotation of the separating wall and preferably of the whole separating part relative to the cover element is prevented, except for a vertical movement or a movement in the direction of the central axis. The form closure is preferably between one or more of the engagement parts and the engagement projections.

In a further detail, the spacer extension may comprise a centering projection and the inner housing may comprise a centering recess for receiving the centering projection. Accordingly, the centering projection is preferably formed opposite to the support extension as viewed in the direction of the central axis. The centering recess may be formed in the bottom of the chamber or, when the chamber is divided into the first and second partial chambers, in the bottom of the second partial chamber.

With regard to filling the closure device, it may also be provided that the first partial chamber is filled with a third liquid or solid medium in addition to a first e.g. gaseous medium. The third medium can then be expelled from the first partial chamber into the second partial chamber together with or by the third medium, e.g. the gaseous medium in the open position.

After filling the second partial chamber, the inner housing is preferably placed on the chamber to close the chamber as a whole or the second partial chamber and brought into sealing cooperation with the chamber.

BRIEF DESCRIPTION OF THE DRAWING

Hereinafter, the invention is further explained with reference to the accompanying drawing, which, however, reproduces only examples of embodiments. Hereby shows:

FIG. 9 a subsequent illustration to FIG. 8, after fitting an inner housing;

DESCRIPTION OF THE EMBODIMENTS

Figure 1:
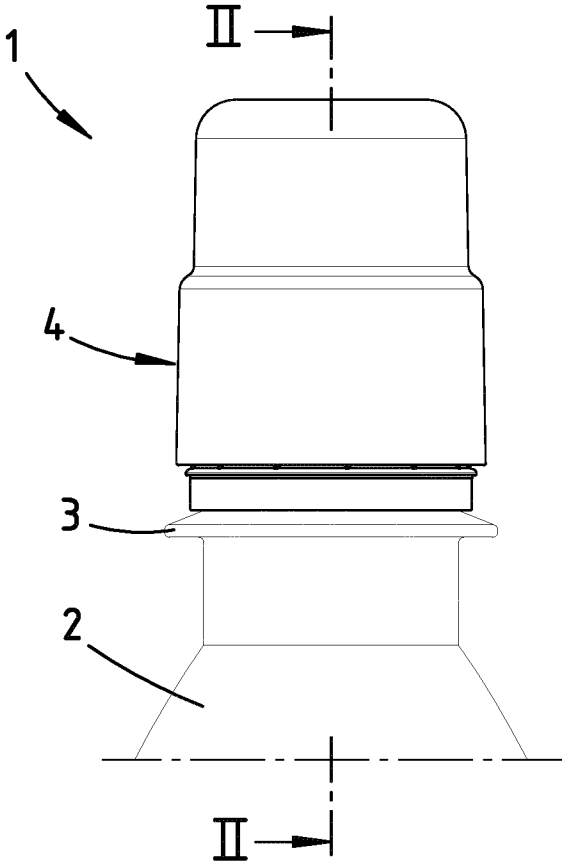
FIG. 1 an external view of a closure device fitted to a container, with partial representation of the container.

The closure device 1, see FIG. 1, is applied to a container 2 in the use state, preferably screw-connected to the container 2.

The container 2 may be a common bottle, for example a plastic bottle, such as a PET bottle.

The container 2 may have associated to the closure device 1 a preferably integrally circumferential annular projection 3. The annular projection 3 may also be referred to as a support ring.

Preferably, in the closed state, the closure device 1 extends only above the annular projection 3.

Figure 2:
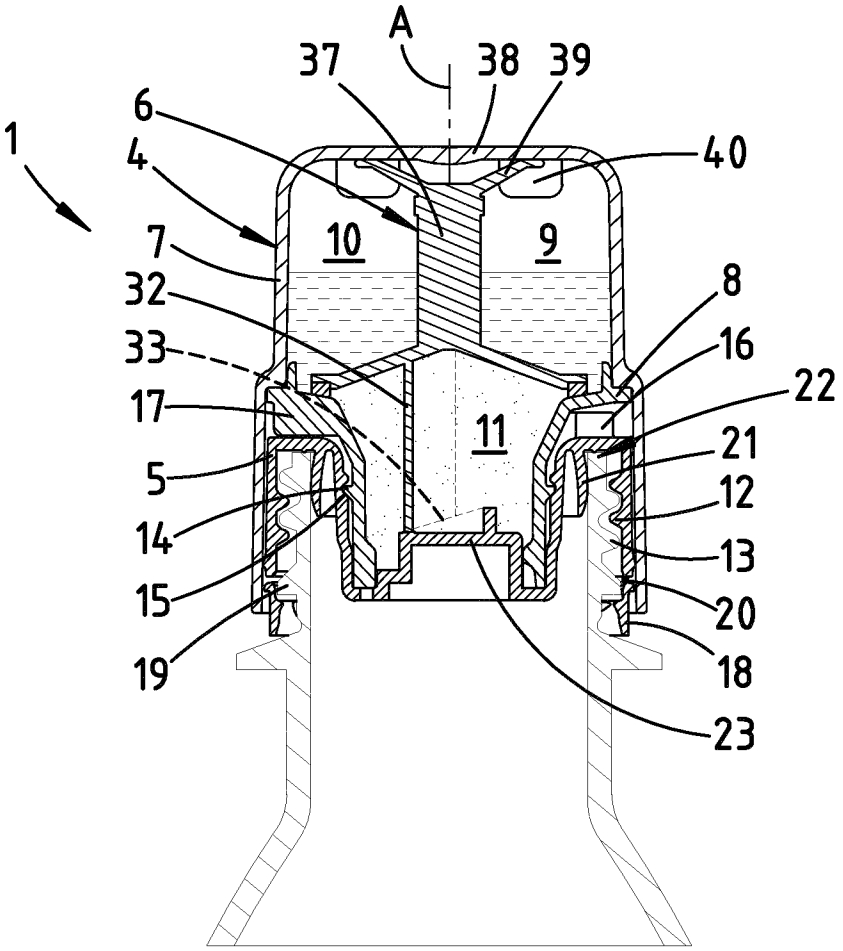
FIG. 2 a longitudinal cross-section through the object according to FIG. 1.

As can also be seen in further detail from FIG. 2, the closure device 1 can have a lid member 4, an inner housing 5 and a separating part 6.

In further detail, the lid member 4 can be composed of a cap part 7 and a base part 8 (shield). Accordingly, the lid member 4 is preferably constructed as such in two parts, which is recommended for manufacturing reasons alone. In principle, however, it can also be constructed in one piece, for example as a blow-moulded part.

In a two-piece configuration, the base part 8 and the cap part 7 are preferably operatively non-detachably connected to each other. For example, the base part 8 and the cap part 7 may be glued or welded together.

The lid member 4 forms a chamber 9 in its interior, which is provided for receiving a medium. As will be explained in more detail below, the chamber 9 can automatically come to empty in the course of a removal of the closure device 1 from the container 2.

In a further detail, two partial chambers created by the separating part 6, a first partial chamber 10 and a second partial chamber 11 are formed when the separating part 6 is in the closed position shown in FIG. 2. The chamber 9 corresponds to a grouping of the first partial chamber 10 and the second partial chamber 11. The first partial chamber 10 and the second partial chamber 11 are arranged substantially one behind the other in the direction of a central axis A.

Figure 5:
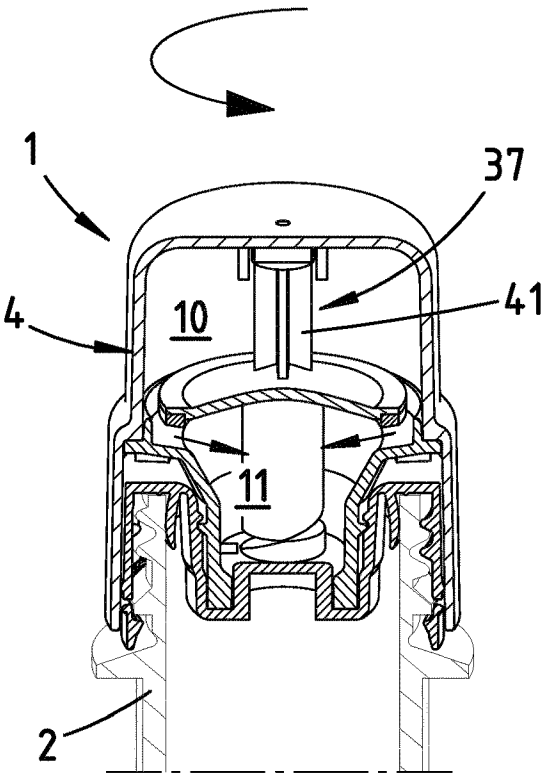
FIG. 5 a representation according to FIG. 4 with the separating part in an open position.

The separating part 6 can be moved between the closed position and an open position, such as that shown in FIG. 5.

A first medium may be received in the first partial chamber 10 and a second medium may be received in the second partial chamber 11. By moving the separating part 6 to the open position, a mixture of the first and second media may be achieved in the second partial chamber or the chamber 9 as a whole. The mixed medium may then be discharged into the container 2. The container 2 may be filled with a further medium, preferably a liquid medium, which may then in turn mix with the mixed medium exiting the closure device 1 before a user can use the mixed substance ultimately present in the container 2 after removal of the closure device 1. The first and second media maybe media which when mixed will maintain the desired property for a longer time. Thus, it can be achieved, that the mixing takes place only once the user intends to use the mixed substance ultimately present in the container 2.

Figure 3:
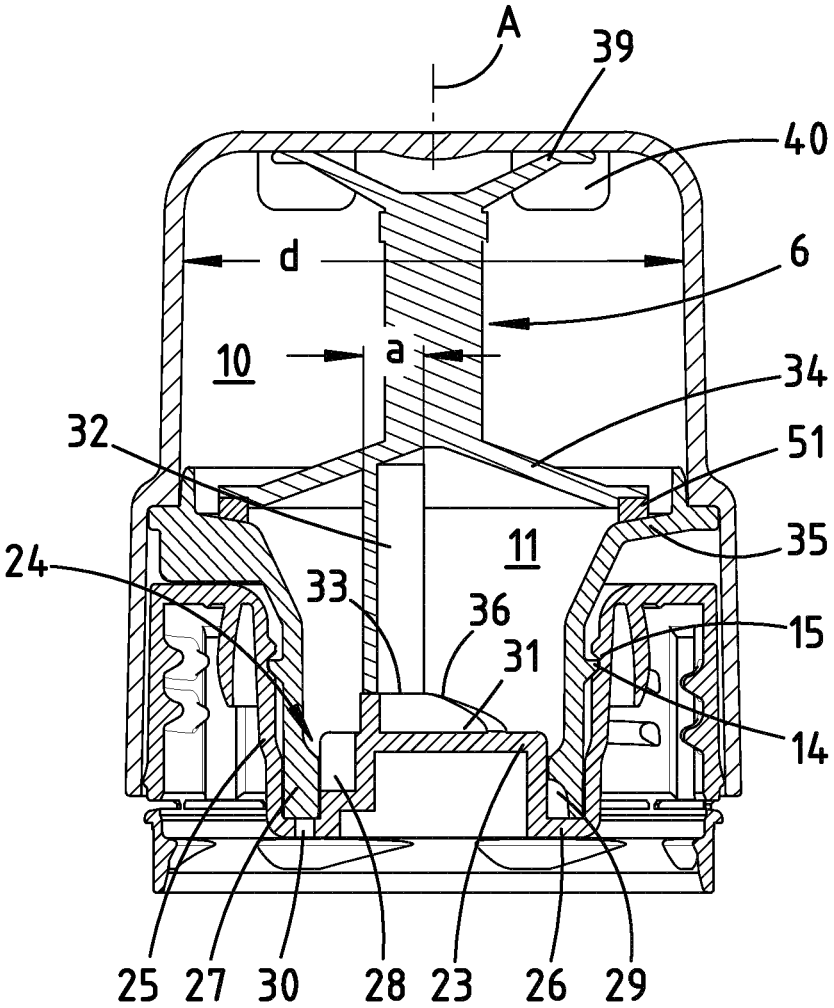
FIG. 3 a representation according to FIG. 2, of the closure device alone.

As can be further seen from the figures, first FIGS. 2 and 3, the inner housing 5 can form a thread, here preferably an internal thread 12, which in the given case can cooperate with a counter thread, here preferably an external thread 13 of the container 2.

The lid member 4 is further preferably provided rotatable relative to the inner housing 5.

The inner housing 5 may be connected to the lid member 4 by latching. The lid member 4 is preferably rotatable further preferably only rotatable, without movement in the direction of the longitudinal axis A, relative to the inner housing 5 in the connected state, further preferably rotatable to a limited angle.

In the embodiment example and preferably, a detent projection 14 is formed on the lid member 4, further preferably on the base part 8, preferably circumferentially on the outside. A detent receptacle 15 is formed on the inner housing 5 with respect to a formation of the detent projection 14.

Furthermore, a stop 16 is preferably formed on the upper side of the inner housing 5, preferably in relation to a state of use approximately according to FIG. 2, which can come into abutment with a stop shoulder 17 formed on the lid member 4, preferably on the base part 8, as will also be explained in more detail below, when the lid member 4 is rotated relative to the inner housing 5.

The lid member 4 can initially be rotated relative to the inner housing 5 without, in the embodiment example in any case, causing a unscrewing movement of the closure device 1 as a whole relative to the container 2. After the stop 16 has been reached by the stop shoulder 17, a further rotation of the lid member 4 then also rotates the inner housing 5, after which a unscrewing movement can occur which at the same time also comprises a movement of the closure device 1 relative to the container 2 in the direction of the central axis A.

The closure device 1, preferably the inner housing 5, is further preferably formed with a tamper evident ring 18. The tamper-evident ring 18, when applied to the container 2 as shown in FIG. 2, may underlie a separating shoulder 19 which is preferably formed on the container 2, further preferably below the external thread 13. The tamper-evident ring 18 is further connected in a conventional manner to the closure device 1, preferably to the inner housing 5 moreover by breakaway webs 20.

In the course of a removal of the closure device 1 from the container 2, in particular said unscrewing, the tamper-evident ring 18 is otherwise separated from the inner housing 5 and preferably remains on the container 2.

As can further be seen from said FIGS. 2 and 3, the inner housing 5 may further form a sealing lip 21. The sealing lip 21 may, as can be seen for example in FIG. 2, be in abutment on the inside with a container mouth 22 of the container 2 in the applied state.

The inner housing 5 further forms a closure projection 23 which, in the initial state applied to the container 2, approximately as shown in FIG. 2, closes a mouth region 24 (see e.g. FIG. 3) of the lid member 4, preferably of the base part 8. The inner housing 5 further forms a closure wall 25 which, together with the closure projection 23, is designed to extend in a U-shape, the connection between the closure wall 25 and the closure projection 23 being provided by a bottom region 26. The sealing lip 21 is preferably formed on the closure wall 25.

In a circumferential groove thus created by the closure projection 23, the bottom region 26 and the closure wall 25, a free end portion 27 of the mouth region 24 of the lid member 4 is sealingly seated, preferably and in the embodiment example of the base part 8 of the lid member 4.

Figure 6:
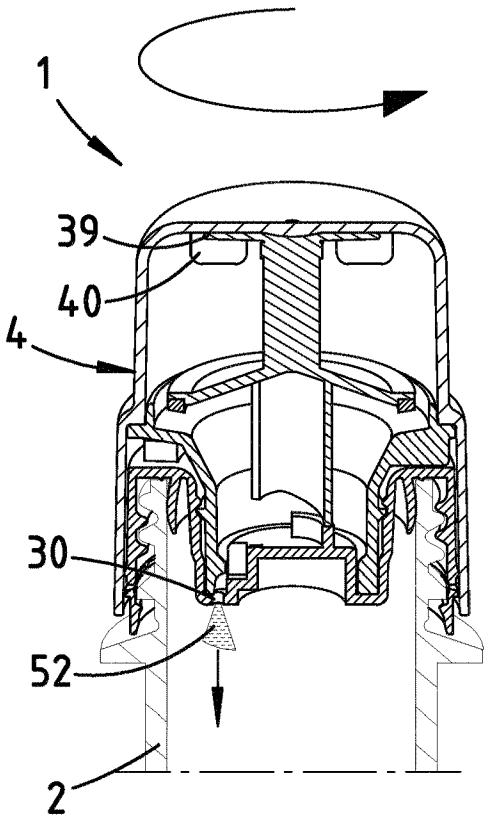
FIG. 6 a representation according to FIG. 5 with the closure device in an outlet position.

The closure projection 23 has an outlet formation 28 on a portion of its periphery, and the free end portion 27 has a counter formation 29 on a portion of its periphery. By rotating the lid member 4 relative to the inner housing 5, the outlet formation 28 and the counter formation 29 can come into overlapping contact with each other, as shown in FIG. 6, for example, so that the medium can escape from the chamber 9.

For this purpose, the inner housing 5 has an outlet opening 30, preferably in the bottom region 26, in a selected peripheral portion region. Since the outlet formation 28 is arranged in the same circumferential region with respect to the closure projection 23 as the outlet opening 30, the outlet in the container 2 is then also given in the said open position.

In this sense, the end portion 27 and the circumferential groove form corresponding closure means and the outlet opening 30 and the outlet formation 28 form corresponding opening means.

Figure 4:
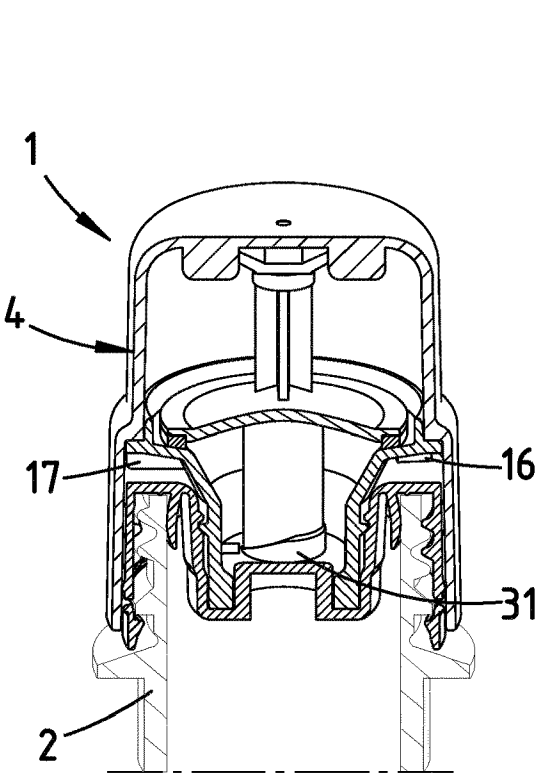
FIG. 4 a representation according to FIG. 2, in perspective, with the separating part in a closed position.
Figure 6:
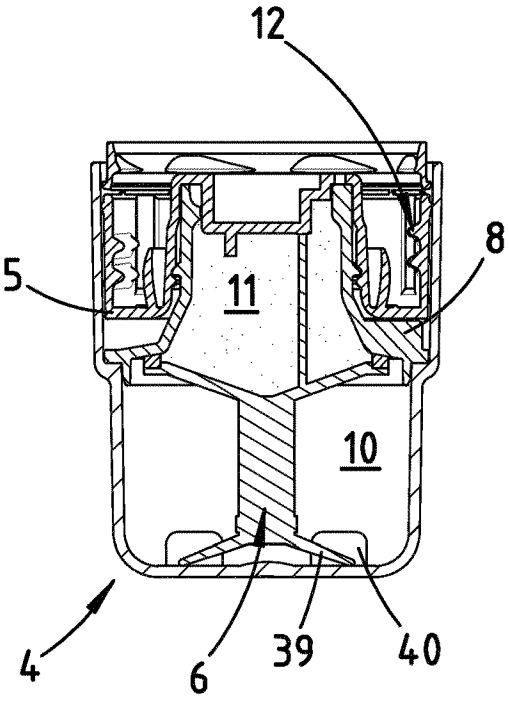

As can be seen in further detail, in particular also from FIG. 4, the inner housing 5 has, preferably on an upper side of the closure projection 23, a lifting part, preferably a ramp part 31. The ramp part 31 is correspondingly formed on the bottom side of the chamber 9 or, in further detail, of the second partial chamber 11.

The separating part 6 further preferably, moreover preferably at a support extension 32, comprises a cooperating surface 33. The cooperating surface 33 serves to cooperate with the ramp part 31, preferably a top surface, in particular a ramp surface 36, of the ramp part 31.

The cooperating surface 33 and/or an associated surface of the ramp part 31 may be increasing in a circumferential direction, preferably circumferential with respect to the central axis A.

The separating part 6 further preferably comprises a separating wall 34. The separating wall 34 extends substantially in a radial direction to a central axis A of the closure device 1 or, in any case, a central axis A of the chamber 9.

In the embodiment and preferably, the separating wall 34 extends in a downwardly swept V-shape with respect to the central axis A, with respect to approximately the cross-section of FIG. 3.

In the closed position, as shown in FIG. 2, the separating wall 34 rests at the edge on a contact shoulder 35 of the chamber 9, which is formed, for example, by the lid member 4 or, in the embodiment example and more specifically, by the base part 8 of the lid member 4. The separating wall 34 may be flexible. In the closure position the separating wall 34 may be bent to a certain degree, what creates a certain restoring force, which may also enhance the desired seal between the first and second partial chamber 10, 11 in the closed state.

The separating wall 34 divides the chamber 9 into the aforementioned first partial chamber 10 and the second partial chamber 11 in the closed position.

The support extension 32 is preferably radially spaced and preferably also circumferentially extended from the central axis A, over a portion of the circumference. The radial distance a may be, for example, one tenth or more of a largest inner diameter d of the chamber 9. The distance a may be, for example, up to one third or one half or more of said largest inner diameter d.

Accordingly, the ramp part 31 is preferably formed with its ramp surface 36 at the same distance and circumferentially, over a partial circumference with respect to the central axis A. The ramp surface 36 preferably serves to interact with the cooperating surface 33.

Referring to the illustrated conditions in a usual closure state, the separating part 6 further comprises a spacer extension 37 at the top of the separating wall 34. The spacer extension 37 provides a distance to a ceiling 38 of the lid member 4.

Further preferably, the spacer extension 37 includes one or more engagement parts 39. A engagement part 39 is an engagement formation. The engagement parts 39 may cooperate with an engagement projection 40 formed internally on the ceiling 38. When the lid member 4 is rotated about the central axis A, the separating part 6 is rotated along with it so that it is lifted according to the lifting part, preferably the ramp part 31, and is moved from the closed position approximately according to FIG. 3 or 4 into the open position according to FIG. 5.

As shown in FIGS. 4 and 5, for example, the spacer extension 37 may be cruciform in cross-section, preferably with four radially extending wing portions 41.

When using the closure device 1, which is applied to the container 2 according to FIG. 1, the user, starting from a position according to FIG. 3 or FIG. 4, rotates the lid element 4 about the central axis A, whereupon the separating part 6 is moved from the closed position according to approximately FIG. 4 into the open position according to FIG. 5. The movement takes place in the direction to the ceiling 38 of the lid member 4.

The movement of the separating part 6 is due to a form fit between the lid member 4 and the separating part 6 on the one hand and the lifting cooperation due to a ramp action between the separating part 6 and the inner housing 5 on the other hand. In more detail, the form fit can be given by the engagement part 39 and the engagement projection 40 of the spacer extention 37 or the ceiling 38 respectively.

As can be seen in FIG. 5, this eliminates the separation of the partial chambers 10 and 11, so that a coherent chamber 9 is formed. Medium present in the partial chamber 10 can flow into the partial chamber 11 and mix with the medium present in the partial chamber 11. Here, preferably, only a rotation of the lid member 4 about the central axis A has initially taken place, without a rotation of the inner housing 5 having taken place at the same time. Accordingly, an unscrewing movement in the sense of a movement in the direction of the central axis A relative to the container 2 has preferably not yet taken place. The inner housing 5 may be hindered at a rotation together with the lid member 4 in this initial first movement by a sufficient friction between the ceiling lip 21 and an inner surface of the container mouth 22 and/or a sufficient friction between an external and internal thread of the inner housing 5 and the container mouth 22. The lid member 4 may, as shown in the figures, extending outside downwards of the inner housing 5 especially also the part of the inner housing 5 making up for the internal thread 12, but at least for a necessary circumferential turning movement, being not in contact with the inner housing 5 in this area.

Since the separation part 6 has been rotated along with the rotation of the lid member 4 in the described manner, the lifting movement of the separation part 6 has occurred due to the ramp cooperation between a corresponding ramp surface of the separation part 6 and the ramp part 31.

This rotation is preferably made possible by the fact that initially, in an initial position according to FIG. 3, the stop shoulder 17 is not yet in abutment with the stop projection 16 on the inner housing 5. The angle of rotation which can be predetermined by the position of the stop shoulder 17 can, for example, be approx. 180 or up to 270 degrees or even more, up to e.g. 310 to 320 degrees, until it comes to abutment with the stop projection 16.

Preferably, the lifting, i.e. the movement of the separating part 6 into the open position, is already completed before the stop shoulder 17 comes into contact with the stop projection 16. For example, on one third to one half or up to two thirds of the circumferential angle of, for example, 180, 270 or 310 degrees given in this respect. At the same time, the counter formation 29 is hereby also rotated with respect to an ultimate alignment with the outlet formation 28. The angle of rotation required for this is decisive for an overall angle of rotation, which is predetermined in the manner mentioned, from an initial position according to approximately FIG. 2 into a stop position towards the stop projection 16. When the stop of the stop shoulder 17 at the stop projection 16 is reached, further rotation of the lid member 4 results in a combined movement with the inner housing 5 and thus in a unscrewing movement from the container 2 with respect to the screw connection preferably given here. There is then also a movement in the direction of the central axis A.

When the above-mentioned stop position is reached, the outlet position as shown in FIG. 6 is also reached. Medium from the chamber 9, which is preferably and specifically the mixed medium from the partial chamber 11, can enter the container 2.

Preferably, the outlet opening 30 is formed with a comparatively small, further preferably circular cross-section. In any case, the design is such that a centered spray jet 52 results, as shown in FIG. 6.

Figure 8:
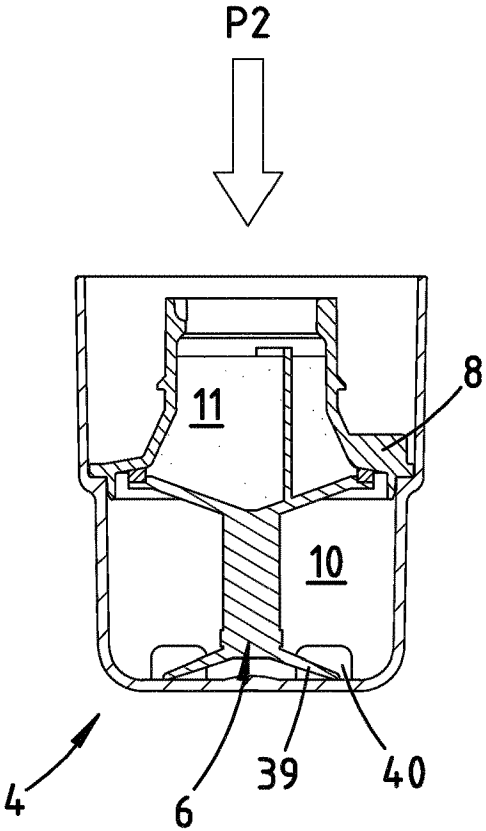
FIG. 8 a representation according to FIG. 7 with the separating part in the closed position and filling of the second partial chamber.
Figure 7:
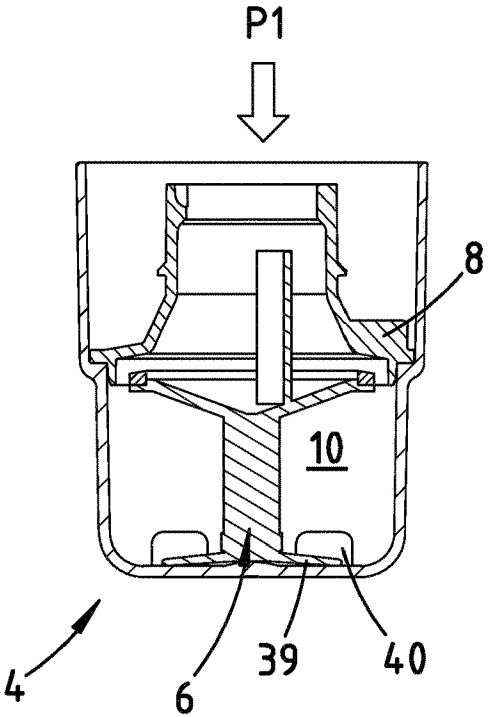
FIG. 7 a lid member with the separating part moved into the open position, when filled with a preferably pressurised medium.

With reference to FIGS. 7 to 9, a possible procedure for filling the closure device 1 is illustrated.

For this purpose, the lid member 4, as far as designed in several parts with inserted and connected base part 8, but without the inner housing 5, is preferably held ready in an inverted position according to FIG. 7. By means of a pushing part not shown in detail, the separating part 6, is pressed down in the direction of an arrow P1 by using an elastic deformability of the preferably wing-like engagement parts 39, so that also the area of the chamber 9, which is located above the separating wall 34 in the usual state of use according to FIG. 2, is accessible. In this state, a first medium can be filled into the lid member 4, which accordingly collects in the space located above the separating wall 34 in the state of use. This first medium may be a liquid. However, it may also just be a pressurized medium, such as a pressurized gas. Furthermore, it may be two media, such as said liquid and additionally said pressurized medium, such as a gas.

Here, pressurized means at a higher pressure than the ambient pressure in use. Preferably, the overpressure is about 4 to 8 bar, more preferably about 6 bar (90 psi).

The pressure on the separating part 6 is then removed so that, according to FIG. 8, a closed first partial chamber 10 results in the space located above the separating wall 34 in the state of use according to FIG. 2. The second partial chamber 11 is now open for filling. In this case, the separating part 6 can be pressed into the closed position by a spring action of the engagement part or parts 39 and/or the pressurized medium.

Thereafter, the second partial chamber 11, which is hereby exposed, can be filled with a further medium, for example a powdery medium.

The inner housing 5 is then placed on the lid member 4, FIG. 9, in the direction of rotation which corresponds approximately to the closed state as shown in FIG. 2. The two partial chambers 10 and 11 are thus filled and separated from each other and also from the environment.

In this state, which also corresponds approximately to the state according to FIG. 3, a placement, for example bouncing or screwing onto a mouth area of the container 2 can then take place, so that ultimately the state according to FIG. 1 is achieved.

Figure 10:
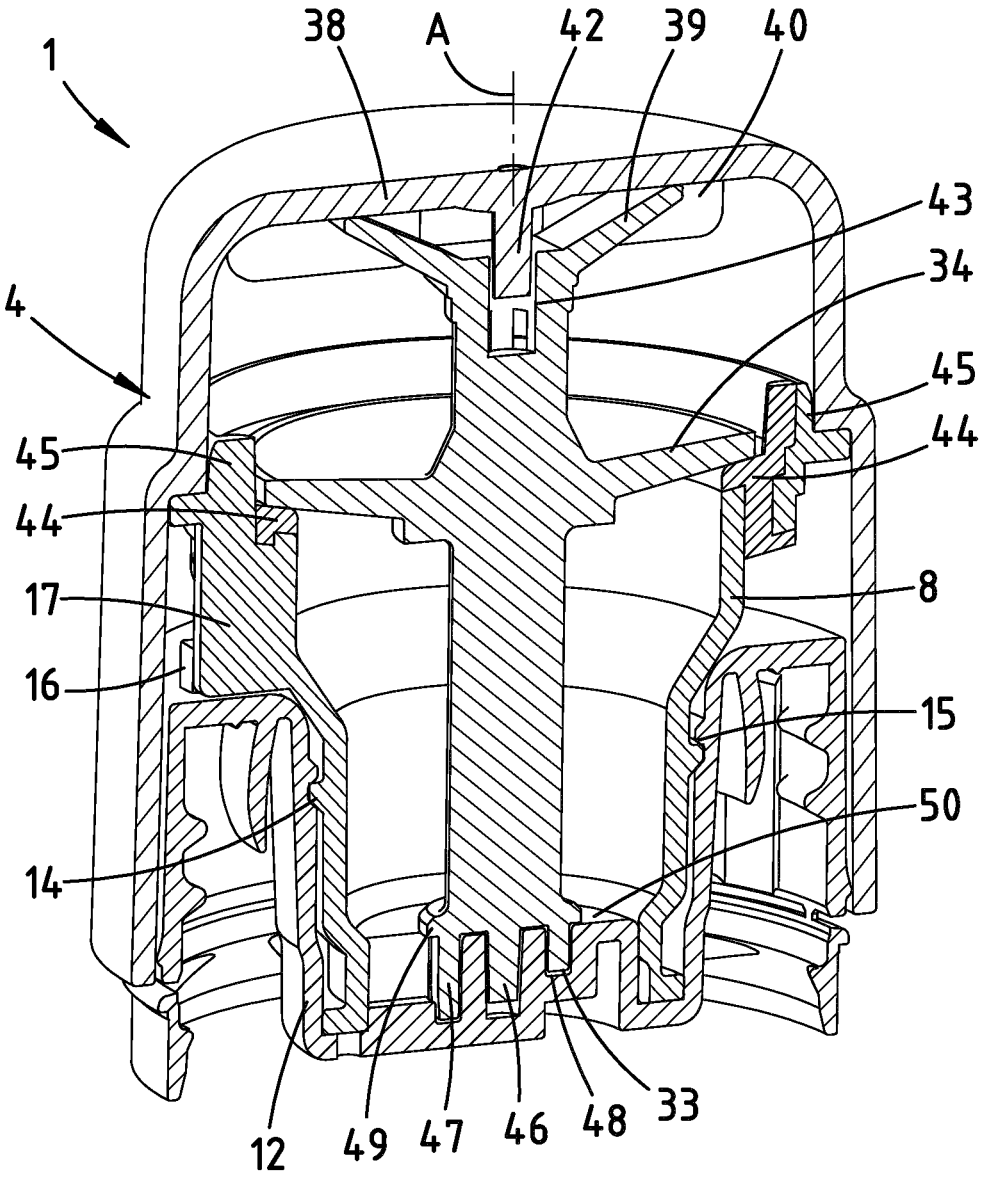
FIG. 10 a representation according to FIG. 4 of a second embodiment.

With reference to FIG. 10, a further embodiment of the closure device 1 is shown. In this case, the separating part 6 has an extension of the separating wall 34 sweeping upwards approximately at right angles or at a small angle.

In further detail, the ceiling 38 may include a centering projection 42 that may engage a centering recess 43 of the separating portion 6.

The base part 8 may comprise a circumferential sealing shoulder 44, which is made of a material that is different from the rest of the base part 8. It may be an elastic material, such as rubber or TPE.

The sealing shoulder can extend upwards beyond the separating wall 34 in the closed state according to FIG. 10, whereby it can form an insertion shoulder 45. The insertion shoulder 45 can advantageously also be used as an attachment point for the sealing shoulder 44. The insertion shoulder 45, here preferably formed by the material of the sealing shoulder 44, can also, as is further shown in FIG. 10, preferably be arranged as an other insertion shoulder 45 opposite one another, be formed by the material, a conventional hard plastic for example, of the lid member 4 or in further detail of the base part 8 in other respects.

By means of two such insertion shoulders 45, which are preferably formed approximately opposite each other, an advantageous centering of the separating part 6 can be further favorably achieved during assembly.

Instead of or in addition to the sealing shoulder 44 on the base part 8, a sealing area 51 may also be provided on the separating wall 34, as also shown in the embodiments of FIGS. 1 to 9. In one and/or both cases, it may also be an insert seal, which is thus, for example, clamp-mounted and not injection-molded for integral connection.

Preferably, the separating part 6 further comprises a lower second centering projection 46.

The first centering projection 42 and/or the second centering projection 46 preferably extend in the region of the central axis A.

When the inner housing 5 is placed in place, a suitable alignment can be achieved by the centering projection 46.

Preferably circumferentially spaced from the second centering projection 46, a ramp formation 47 is provided on the separating part 6, foot side. The ramp formation 47 cooperates with a counter-ramp formation 48 on the inner housing 5, preferably formed on the closure projection 23 of the inner housing 5. The counter-ramp formation 48 preferably also corresponds in its action to the ramp part 31 of the previously described embodiments.

A circumferential overgrip flange 49 may further preferably be formed on the separating part 6 above the ramp formation 47. The overgrip flange 49 may come into contact with an upper surface 50 of the closure projection 23.

Figure 13:
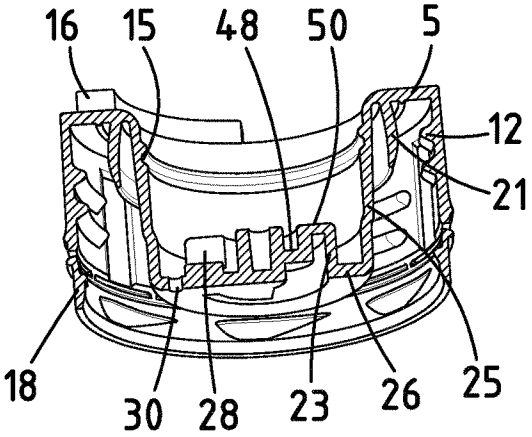
FIG. 13 a cross-section through the object according to FIG. 11, cut along the line XIII-XIII.
Figure 12:
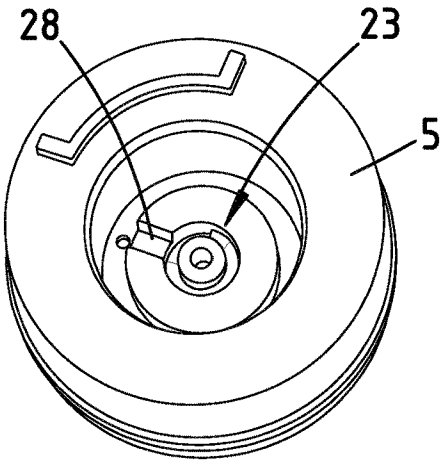
FIG. 12 a representation according to FIG. 11, in perspective view.
Figure 11:
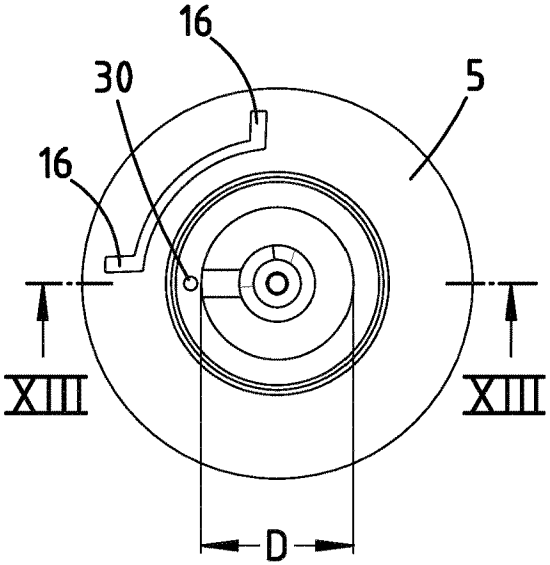
FIG. 11 a top view of the inner housing.

With reference to FIGS. 11 to 13, the inner housing 5 is shown in detail.

Here, it can be seen that two stop projections 16 are preferably formed, which are further preferably spaced apart by a circumferential angle of about 45 degrees, leaving a free space for turning in this case of about 315 degrees. They may be connected to each other by a connecting rib.

Furthermore, the outlet opening 30 is also identifiable with respect to its small diameter as well. A diameter of the outlet opening 30 preferably corresponds to a fifth or less of a diameter D of the closure projection 23. Further preferably a tenth or less, up to for example a twentieth.

The outlet formation 28 may be formed as a continuous, radially extending channel, in the closure projection 23. It is further preferably, as can be seen in particular also from FIG. 13, located only in the region which is radially outside the ramp formation.

Figure 15:
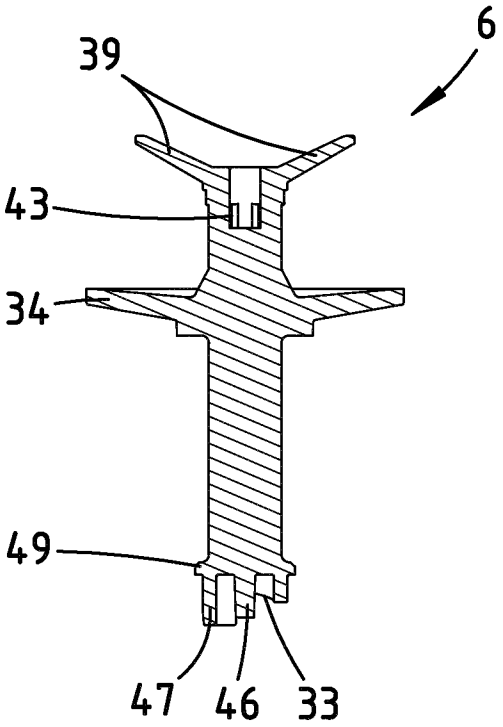
FIG. 15 a cross-section of the object according to FIG. 14, cut in the plane XV-XV.
Figure 14:
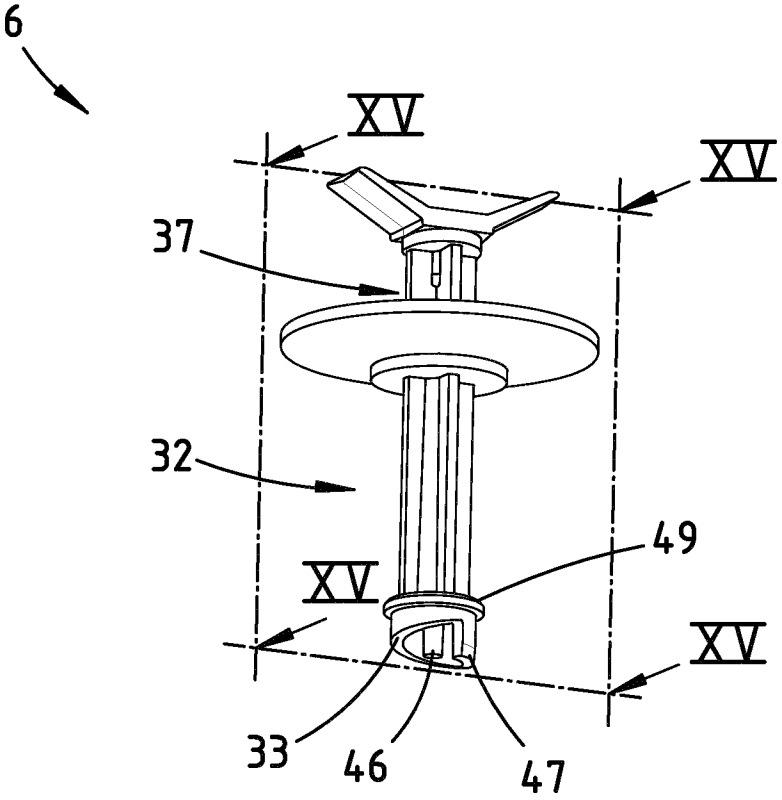
FIG. 14 a separating part of the second embodiment in perspective view.
Figure 16:
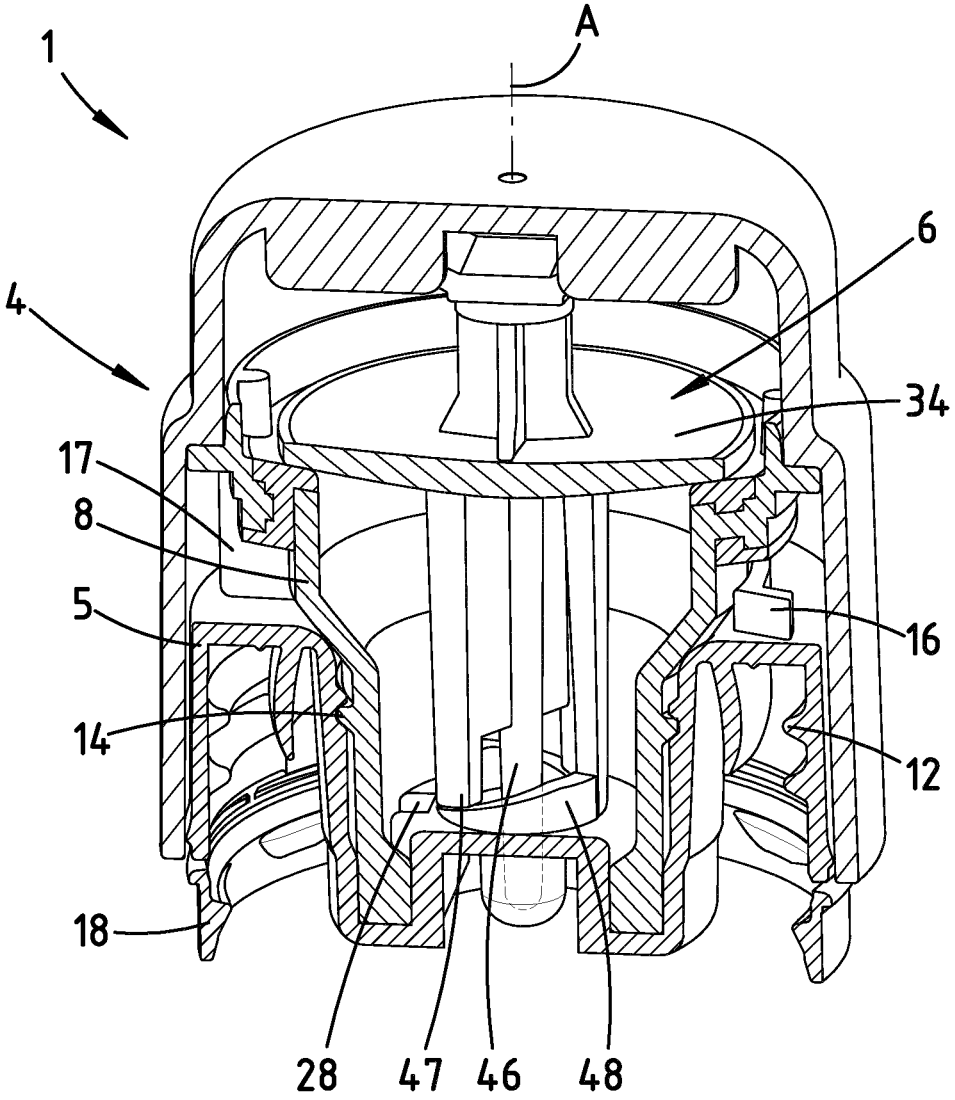
FIG. 16 a representation according to FIG. 4 and FIG. 10 respectively of a third embodiment.
Figure 18:
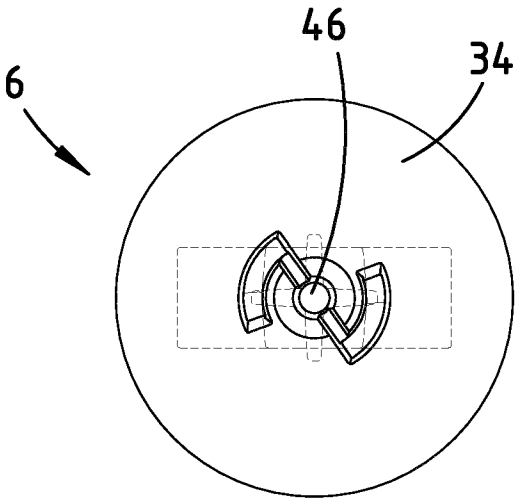
FIG. 18 a bottom view of the object according to FIG. 17.
Figure 17:
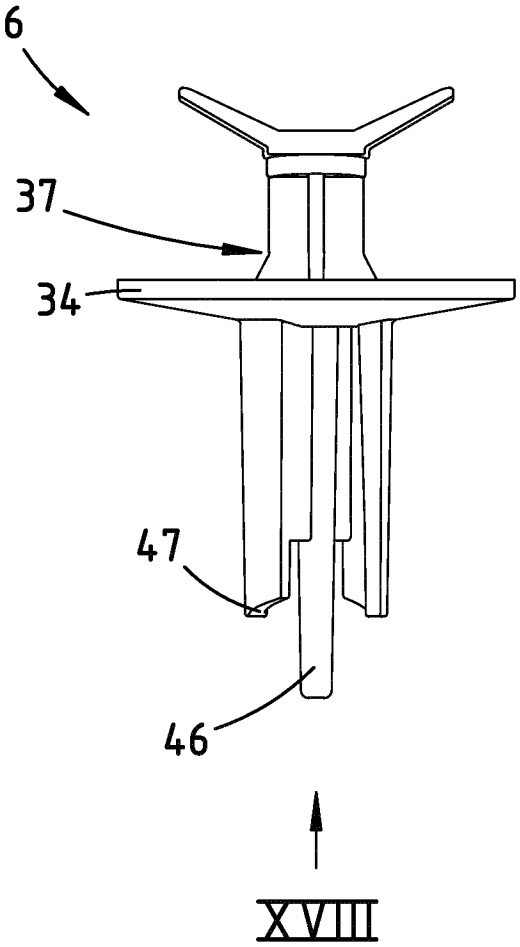
FIG. 17 a side view of the separating part of the third embodiment.
Figure 20:
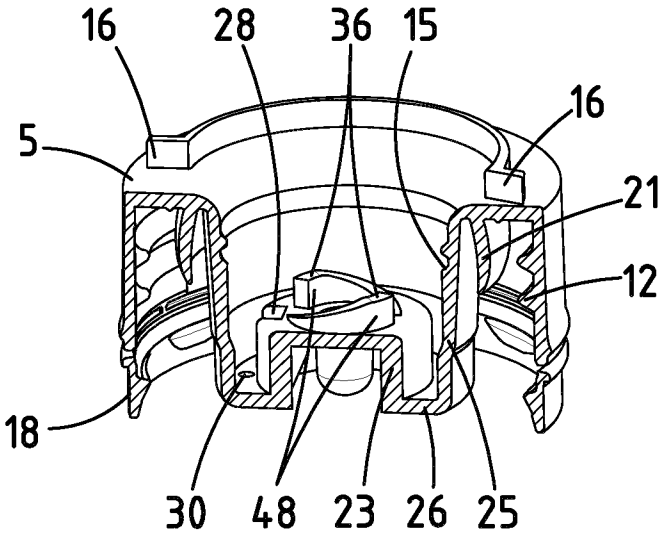
FIG. 20 a secant section of the object according to FIG. 19, cut along the line XX-XX.
Figure 19:
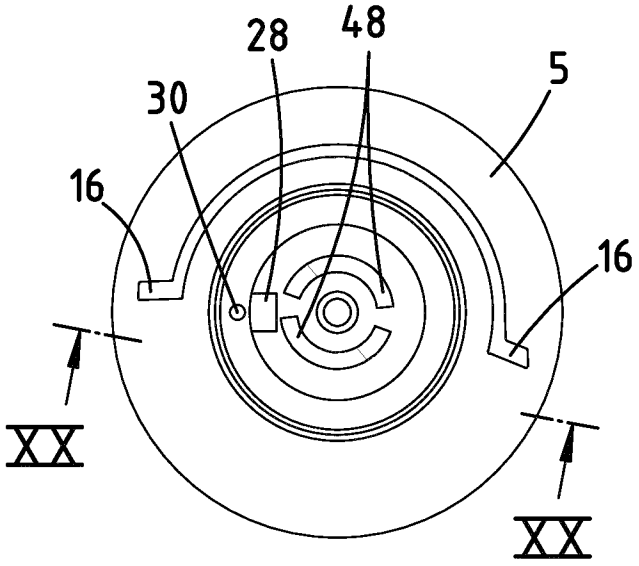
FIG. 19 a top view of the inner housing of the third embodiment.

FIGS. 14 and 15 show the separating part 6 of the second embodiment in further detail.

As with the separating portion 6 of the first embodiment, the spacer extension 37 and/or the support extension 32 is formed cruciform in a cross-section perpendicular to the axis A.

In particular, with reference to FIGS. 16 to 20, there is again shown an embodiment formed in some embodiments further different from the embodiments previously described.

In particular, a second centering protrusion 46 is formed on the separating part 6 and projects downwardly substantially beyond the ramp formation 47. Furthermore, two ramp formations 47 are provided which are circumferentially separate from each other.

Two corresponding counter ramp formations 48 are also formed on the closure projection 23.

With reference to FIGS. 21 to 27, a further filling operation of the described embodiments is again illustrated.

Figure 21:
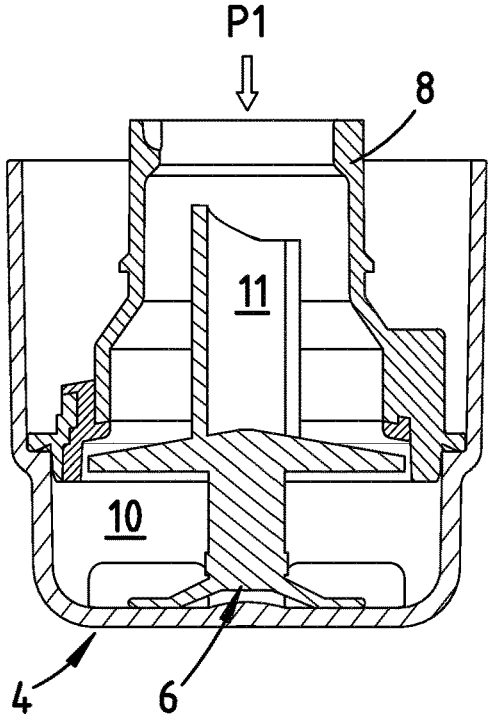
FIG. 21 a representation according to FIG. 6, concerning the second embodiment.
Figure 22:
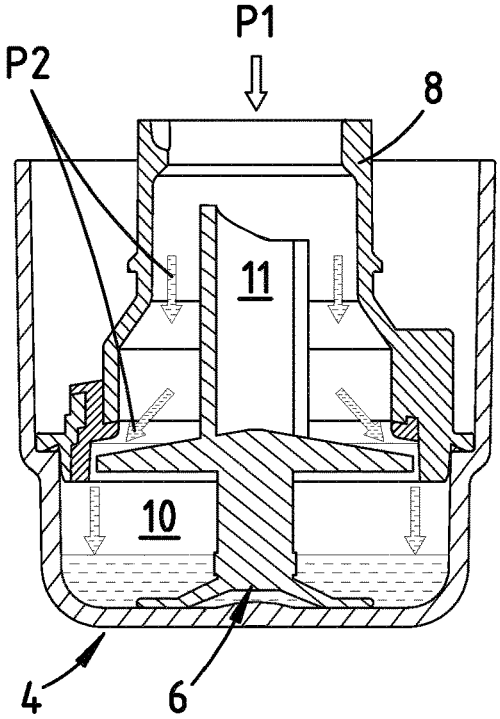
FIG. 22 a representation according to FIG. 21; when filled with a first, preferably liquid medium.

In FIG. 21, the separating part 6 is first pressed down again, so that a filling of the space part which later corresponds to the partial chamber 10 can be carried out. According to FIG. 22, liquid is introduced into this part of the chamber, as indicated by arrows P2.

Figure 23:
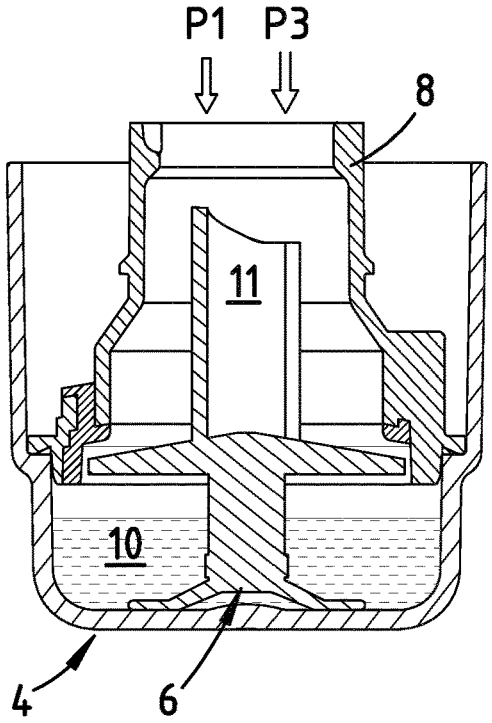
FIG. 23 a representation according to FIGS. 21 and 22 respectively when filled with a pressurised medium.
Figure 24:
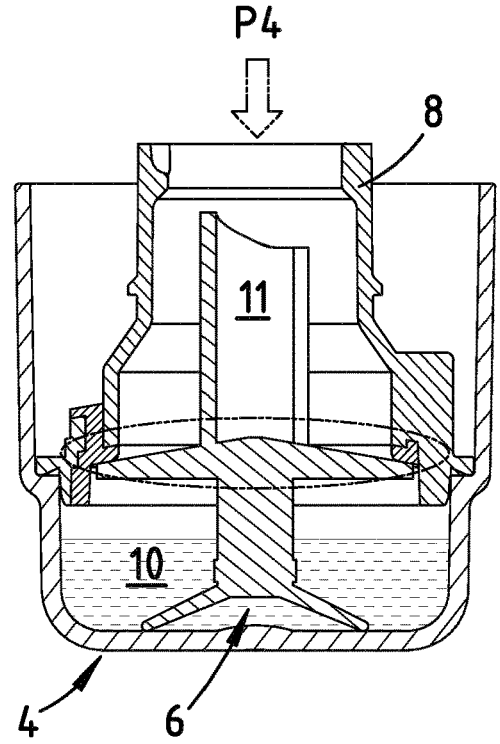
FIG. 24 a subsequent step in the course of filling to FIG. 23, concerning a drying.

Then, with the separating part 6 still depressed, FIG. 23, pressurized gas is injected, as indicated by arrows P3. Then the pressure, arrow P1, on the separating part 6 is removed, so that the separating part 6 according to FIG. 24 comes into the closing state. Here, both a liquid medium and a gaseous pressurized medium are present in the now created first partial chamber 10. FIG. 24 further illustrates that a drying step can then take place, arrow P4. For example, drying can be carried out with hot air.

Figure 25:
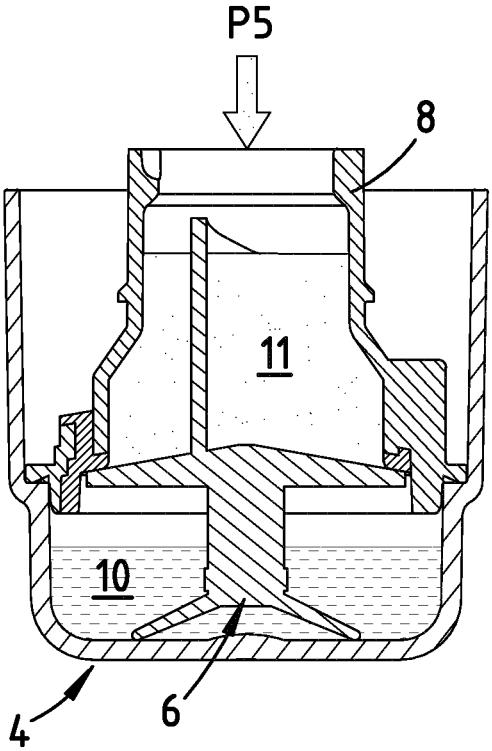
FIG. 25 a filling of the object according to FIG. 24 with a second medium.

Further on, FIG. 25, the space of the later partial chamber 11 is then filled, in the embodiment example with a powdery medium, arrow P5.

Figure 26:
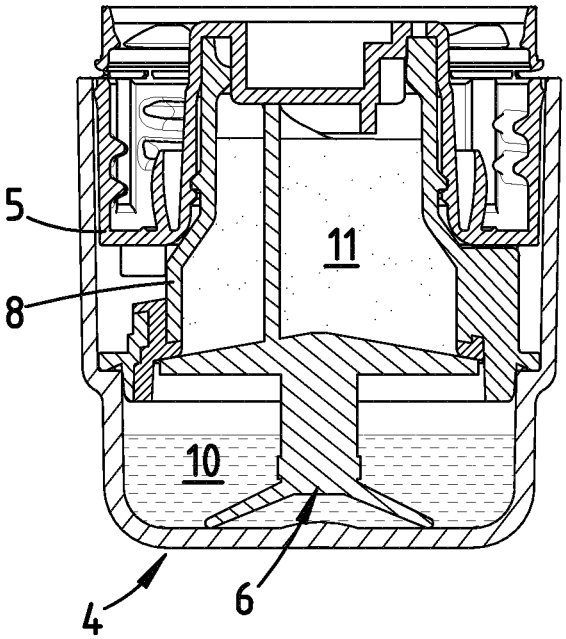
FIG. 26 the object according to FIG. 25 after fitting the inner housing.
Figure 27:
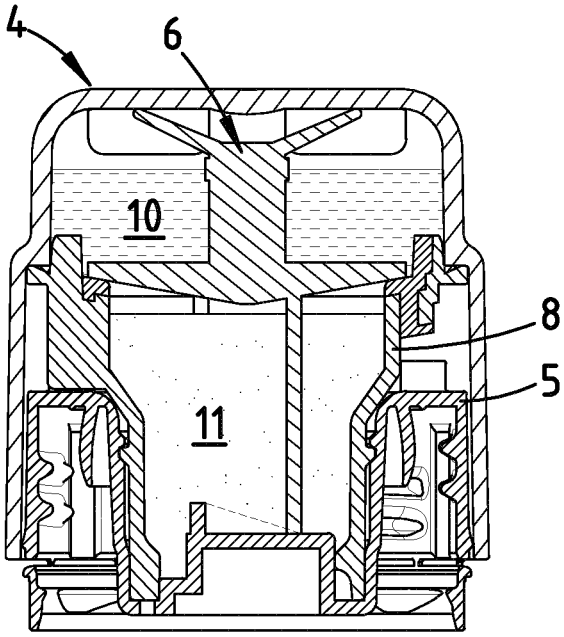
FIG. 27 the object according to FIG. 26 after turning over into a ready position for application to a container.

Then, FIG. 26, the inner housing 5 is again placed in an orientation corresponding to a closed state. After turning over as shown in FIG. 27, the thus filled closure part is ready to be placed on the container 2.

Figure 30:
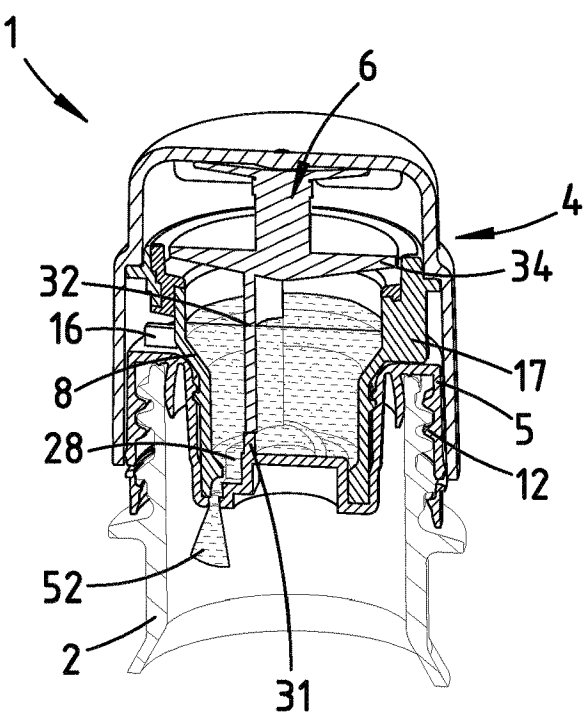
FIG. 30 the closure device according to FIG. 29 after a further rotation by a total of, for example, 180 degrees.
Figure 29:
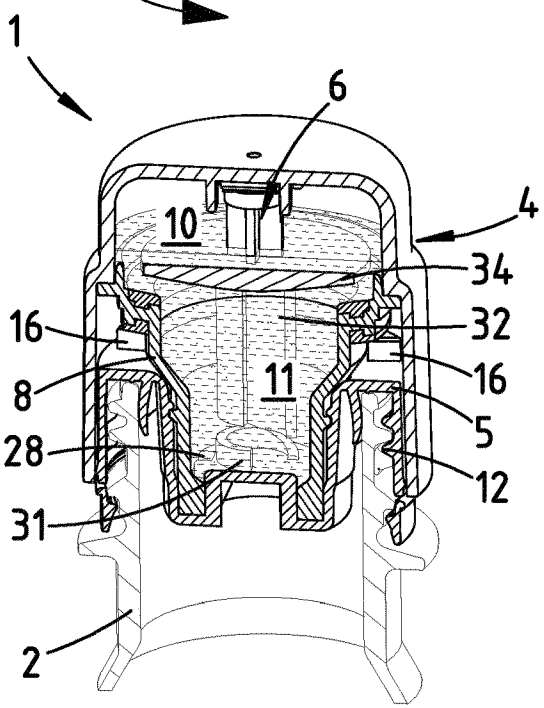
FIG. 29 the closure device according to FIG. 28 after a first rotation of, for example, 90 degrees.
Figure 28:
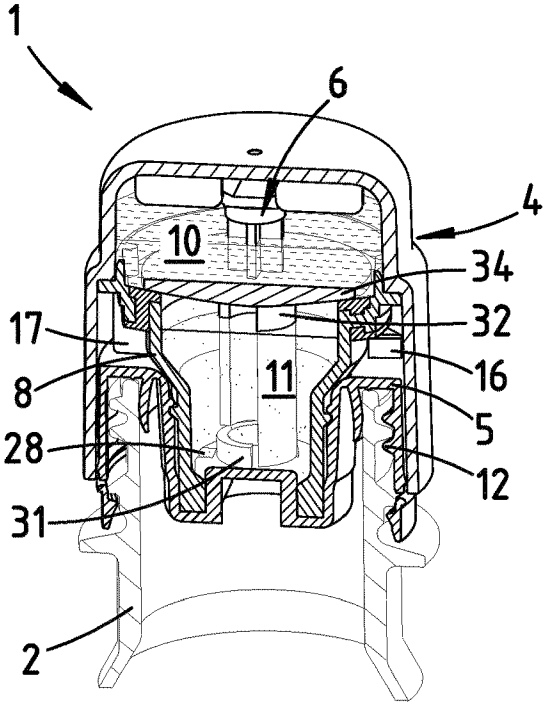
FIG. 28 a longitudinal section through a closure device located on the container in an initial state.

With reference to FIGS. 28 to 30, with respect to a closure device 1 filled in this manner, the emptying process is again illustrated.

In the initial state, FIG. 28, the stop shoulder 17 is in contact with the second stop projection 16 (located behind it, not visible). In the usual direction of rotation, as is given for unscrewing, counterclockwise, a rotation of the lid member 4 relative to the inner housing 5 then takes place, whereby in an intermediate position according to FIG. 29, after a rotation of, for example, 90 degrees, the separating part 6 is in the open position and, driven by the medium under pressure, the further medium, preferably the liquid, runs out of the first partial chamber 10 into the second partial chamber 11; then, in the second partial chamber 11, with the chambers, the partial chamber 10 and the partial chamber 11, now connected again, a mixing state results as shown in FIG. 30, wherein, on completion of the rotary movement through e.g. 180 degrees, the outlet according to FIG. 30 results. Due to the preferably small opening area of the outlet opening 30, a concentrated spray 52 is achieved.

The closure device 1 preferably consists entirely of plastic parts. Suitable plastic materials include, for example, polypropylene, polyethylene, PBT (polybutylene terephthalate), and with respect to a soft plastic material, for example TPE (thermoplastic elastomer). Preferably, the cap part 7 is made of PBT.

Preferably, the separating part 6 is also made of PBT. In particular, in the case where a seal is moulded on, as in the first embodiment examples, this may comprise TPE. In this respect, a two-component moulded part may be present.

The base part 8 is preferably also made of PBT and, insofar as a seal is moulded thereon as described, this may also be a two-component moulded part. In this case, the seal may also comprise a TPE, for example.

For example, the inner housing may be injection molded from polypropylene.

The first partial chamber 10 may have a volume of, for example, 8 to 15 ml, further preferably 10 to 14 ml, more preferably about 12.5 ml. When filled, this volume may be half filled with a gas under negative pressure and half filled with a liquid, for example. Further preferably, however, the gas is provided with a larger volume than the liquid. For example, with 1.3 to 2.5 times the volume of the liquid. For example, with respect to the gas a volume of 6 to 9 ml, more preferably 8.5 ml, and with respect to the liquid a volume of 3 to 5 ml, more preferably 4 ml, may be provided.

Preferably, the second sub-chamber 11 has a smaller volume than the first sub-chamber 10. Further preferably, the second sub-chamber 11 has a volume equal to half or less of the volume of the first sub-chamber 10. For example, the second partial chamber 11 may have a volume of 3 to 5 ml, further preferably about 3.5 to 4 ml.

| Listof reference signs | |
|---|---|
| 1 | closure device |
| 2 | container |
| 3 | annular projection |
| 4 | lid member |
| 5 | inner housing |
| 6 | separating part |
| 7 | cap part |
| 8 | base part |
| 9 | chamber |
| 10 | first partial chamber |
| 11 | second partial chamber |
| 12 | internal thread |
| 13 | external thread |
| 14 | detent projection |
| 15 | detent receptacle |
| 16 | stop |
| 17 | stop shoulder |
| 18 | temper evident ring |
| 19 | separating shoulder |
| 20 | breakaway wraps |
| 21 | sealing lip |
| 22 | container mouth |
| 23 | closure projection |
| 24 | mouth region |
| 25 | closure wall |
| 26 | bottom region |
| 27 | free end portion |
| 28 | outlet formation |
| 29 | counter formation |
| 30 | outlet opening |
| 31 | ramp part |
| 32 | support extention |
| 33 | cooperating surface |
| 34 | separating wall |
| 35 | contact shoulder |
| 36 | ramp surface |
| 37 | spacer extension |
| 38 | ceiling |
| 39 | engagement part |
| 40 | engagement projection |
| 41 | wing portion |
| 42 | centering projection |
| 43 | centering recess |
| 44 | sealing shoulder |
| 45 | insertion shoulder |
| 46 | second centering projection |
| 47 | ramp formation |
| 48 | counter ramp formation |
| 49 | overgrip flange |
| 50 | upper surface |
| 51 | sealing area |
| 52 | spray jet |
| A | central axis |
| D | Diameter |
| P1 | Arrow |
| P2 | Arrow |
| P3 | Arrow |
| P4 | Arrow |

-continued

| Listof reference signs | |
|---|---|
| P5 | Arrow |
| a | radial distance |
| d | large inner diameter |

The invention claimed is:

1. A closure device (1) for a container (2) having a container opening, the closure device (1) comprising:

a lid member (4) configured for closing the container opening, a chamber (9) associated with the lid member (4) and an inner housing (5), the chamber (9) and the inner housing (5) having closure means and opening means corresponding to one another, which interact with one another in such a way that a medium contained in the chamber (9) can escape into the container (2) as a result of a movement of the lid member (4) relative to the inner housing (5), wherein the chamber (9) is divided by a separating part (6) into a first partial chamber (10) and a second partial chamber (11), wherein the first partial chamber (10) and the second partial chamber (11) are arranged one behind the other along a central axis (A) of the closure device, wherein the separating part (6) is configured to be moved from a closure position into an opening position, wherein the first partial chamber and second partial chamber are configured such that a first medium can be received in the first partial chamber (10) and a second medium can be received in the second partial chamber (11), wherein moving the separating part (6) into the open position enables mixing of the first and the second medium in the chamber (9) to form a mixed medium, and wherein the mixed medium can emerge into the container (2) as a result of the movement of the lid member (4), wherein the separation part (6) comprises a separating wall (34) extending radially and circumferentially with respect to the central axis (A), and wherein, in the closure position, the separating wall (34) rests in a sealing manner on an edge side on a stop shoulder (17) of the chamber (9).

2. The closure device according to claim 1, wherein the separating part (6) is movable into the opening position in a direction of the central axis (A).

3. The closure device according to claim 1, wherein the separating part (6) is biased into the closure position.

4. The closure device according claim 1, wherein the separating wall (34) comprises a support extension (32) projecting into the second partial chamber (11).

5. The closure device according to claim 4, wherein the support extension (32) cooperates with a ramp part (31) formed in the second partial chamber (11) on a bottom side.

6. The closure device according to claim 4, wherein the separating wall (34) comprises a spacer extension (37) extending in opposition to the support extension (32).

7. The closure device according to claim 6, wherein the spacer extension (37) bears on an inside against a ceiling (38) of the lid member (4).

8. The closure device according to claim 6, wherein the spacer extension (37) comprises a springable portion.

9. The closure device according to claim 1, wherein the movement of the separating part (6) into the open position is effected by the movement of the lid member (4).

10. The closure device according to claim 7, wherein the ceiling (38) of the lid member (4) comprises an engagement projection and wherein the spacer extension (37) comprises an engagement recess configured for receiving the engagement projection.

11. The closure device according to claim 6, wherein the spacer extension (37) has a centering projection (42) and wherein the inner housing has a centering recess (43) configured for receiving the centering projection (42).

12. A method for filling a closure device (1) for a container (2), wherein the filled closure device (1) can be placed on a container opening, wherein the closure device (1) has a lid member (4) for closing the container opening, a chamber (9) associated with the lid member (4) and an inner housing (5), wherein the chamber (9) and the inner housing (5) have closure means and opening means corresponding to one another, which interact with one another in such a way that a medium contained in the chamber (9) can escape into the container (2) as a result of a movement of the cover element (4) relative to the inner housing (5), comprising the steps of:

providing a separating part (6) in the form of a separating wall (34) for dividing the chamber (9) into a first partial chamber (10) and a second partial chamber (11) according to which the first partial chamber (10) and the second partial chamber (11) are arranged one behind the other along a central axis (A) of the closure part, moving the separation part from a closure position into an opening position, wherein the separating part (6) is moved into the open position before being placed on the container (2) and before the inner housing (5) is connected to the lid member (4), filling the first partial chamber (10) which is opened as a result with a first medium which is or becomes at an overpressure with respect to an ambient pressure, securing the separating part (6) in the closure position by the overpressure, so that in the closure position, the separating wall (34) rests in a sealing manner on an edge side on a stop shoulder (17) of the chamber (9), and filling the second partial chamber (11) created by the closure position with a second medium.

13. The method according to claim 12, wherein the first partial chamber (10) is filled with a third liquid or solid medium in addition to the first medium.

* * * * *